US011432092B2

(12) United States Patent
Amadu

(10) Patent No.: US 11,432,092 B2
(45) Date of Patent: Aug. 30, 2022

(54) METHOD AND SYSTEM FOR PROCESSING AN AUDIO SIGNAL INCLUDING AMBISONIC ENCODING

(71) Applicant: ARKAMYS, Paris (FR)

(72) Inventor: Frédéric Amadu, Chelles (FR)

(73) Assignee: ARKAMYS

( * ) Notice: Subject to any disclaimer, the term of this patent is extended or adjusted under 35 U.S.C. 154(b) by 0 days.

(21) Appl. No.: 16/634,193

(22) PCT Filed: Jul. 17, 2018

(86) PCT No.: PCT/EP2018/069402
§ 371 (c)(1),
(2) Date: Jan. 27, 2020

(87) PCT Pub. No.: WO2019/020437
PCT Pub. Date: Jan. 31, 2019

(65) Prior Publication Data

US 2020/0186952 A1 Jun. 11, 2020

(30) Foreign Application Priority Data

Jul. 28, 2017 (FR) ..... 1757191

(51) Int. Cl.
*H04S 7/00* (2006.01)
*G10L 19/008* (2013.01)
(Continued)

(52) U.S. Cl.
CPC ..... *H04S 7/30* (2013.01); *G10L 19/008* (2013.01); *H04R 1/406* (2013.01); *H04R 3/005* (2013.01);
(Continued)

(58) Field of Classification Search
CPC ..... H04S 7/30; H04S 3/008; H04S 2400/01; H04S 2400/15; H04S 2420/11;
(Continued)

(56) References Cited

U.S. PATENT DOCUMENTS

2013/0170666 A1 7/2013 Ng et al.
2013/0230187 A1 9/2013 Kuech et al.
2018/0227665 A1* 8/2018 Elko ..... H04R 1/406

OTHER PUBLICATIONS

Rilin Chen et al., "A triple microphone array for surround sound recording", Institute of Acoustics, Chinese Academy of Sciences, China, Nov. 19, 2014, retrieved from Internet on Jul. 22, 2015, pp. 1-7.

(Continued)

*Primary Examiner* — Paul Kim
*Assistant Examiner* — Douglas J Suthers
(74) *Attorney, Agent, or Firm* — Perman & Green, LLP

(57) ABSTRACT

A method for processing a sound signal including synchronously acquiring an input sound signal $S_{input}$ by means of at least two omnidirectional microphones, encoding the input sound signal $S_{entréeinput}$ in a sound data D format of the ambisonics type of order R, R being a natural number greater than or equal to one, the encoding step including a directivity optimisation sub-step carried out by means of filters of the Finite Impulse Response filter type. Each of the signals acquired by the microphones is filtered during the directivity optimisation sub-step by a FIR filter, then subtracted from an unfiltered version of each of the other signals in order to obtain N enhanced signals. The present invention also relates to a system for processing the sound signal.

10 Claims, 5 Drawing Sheets

(51) Int. Cl.

| | |
|---|---|
| ***H04R 1/40*** | (2006.01) |
| ***H04R 3/00*** | (2006.01) |
| ***H04R 5/027*** | (2006.01) |
| ***H04S 3/00*** | (2006.01) |

(52) U.S. Cl.
CPC ..... *H04R 5/027* (2013.01); *H04S 3/008* (2013.01); *H04R 2201/401* (2013.01); *H04S 2400/01* (2013.01); *H04S 2400/15* (2013.01); *H04S 2420/11* (2013.01)

(58) Field of Classification Search
CPC ..... G10L 19/008; H04R 1/406; H04R 3/005; H04R 5/027; H04R 2201/401
USPC ..... 381/23
See application file for complete search history.

(56) References Cited

OTHER PUBLICATIONS

Christof Faller et al., "Conversion of Two Closely Spaced Omnidirectional Microhpone Signals to an XY Stereo Signal", AES Convention 129, New York, Nov. 4, 2010, pp. 1-10.
International Search Report of International Patent Application PCT/EP2018/069402 dated Aug. 8, 2018.

* cited by examiner

METHOD AND SYSTEM FOR PROCESSING AN AUDIO SIGNAL INCLUDING AMBISONIC ENCODING

CROSS REFERENCE TO RELATED APPLICATIONS

This application is a National Stage of International Application No. PCT/EP2018/069402, having an International Filing Date of 17 Jul. 2018, which designated the United States of America, and which International Application was published under PCT Article 21(2) as WO Publication No. 2019/020437 A1, which claims priority from and the benefit of French Patent Application No. 1757191, filed on 28 Jul. 2017, the disclosures of which are incorporated herein by reference in their entireties.

BACKGROUND

1. Field

The present disclosure relates to the field of processing sound signals.

More particularly, the present disclosure relates to the field of recording a 360° sound signal.

2. Brief Description of Related Developments

Methods and systems are known in the prior art for broadcasting 360° video signals. There is a need in the prior art to be able to combine sound signals with these 360° video signals.

Until now, 3D audio has been reserved for sound professionals and researchers. The purpose of this technology is to acquire as much spatial information as possible during the recording to then deliver this to the listener and provide a feeling of immersion in the audio scene.

In the video sector, interest is growing for videos filmed at 360° and reproduced using a virtual reality headset for full immersion in the image: the user can turn his/her head and explore the surrounding visual scene. In order to obtain the same level of precision in the sound sector, the most compact solution involves the use of an array of microphones, for example the Eigenmike by mh acoustics, the Soundfield by TSL Products, and the TetraMic by Core Sound. The polyhedral shape of the microphone arrays allows for the use of simple formulae to convert the signals from the microphones into an ambisonics format. The ambisonics format is a group of audio channels resulting from directional encoding of the acoustic field, and contains all of the information required for the spatial reproduction of the sound field. Equipped with between four and thirty-two microphones, these products are expensive and thus reserved for professional use.

Recent research has focused on encoding in ambisonics format on the basis of a reduced number of omnidirectional microphones. The use of a reduced number of this type of microphones allows costs to be reduced.

By way of example, the publication entitled "A triple microphonic array for surround sound recording" by Rilin CHEN ET AL. discloses an array comprised of two omnidirectional microphones which directivity patterns are virtually modified by applying a delay to one of the signals acquired by the microphones. The resulting signals are then combined to obtain the sound signal in ambisonics format.

One drawback of the method described in this prior art is that the microphones array is placed in a free field. In practice, when an obstacle is placed between the two microphones, diffraction phenomena cause attenuations and phase shifts of the incident wave differentiated according to the frequencies. As a result, the application of a delay to the signal received by one of the microphones will not allows for a faithful reproduction of the sound signal received because the delay applied will be the same at all frequencies.

SUMMARY

The disclosure aims to overcome the drawbacks of the prior art by proposing a method for processing a sound signal allowing the sound signal to be encoded in ambisonics format on the basis of signals acquired by at least two omnidirectional microphones.

The disclosure relates to a sound signal processing method, comprising the steps of:

- synchronously acquiring an input sound signal $S_{input}$ by means of N omnidirectional microphones, N being a natural number greater than or equal to two;
- encoding said input sound signal $S_{input}$ in a sound data D format of the ambisonics type of order R, R being a natural number greater than or equal to one, said encoding step comprising a directivity optimisation sub-step carried out by means of filters of the Finite Impulse Response FIR filter type, and said encoding step comprising a sub-step of creating an output sound signal $S_{output}$ in the ambisonics format from enhanced signals derived from the directivity optimisation sub-step;
- rendering the output sound signal $S_{output}$ by means of digitally processing said sound data D;

According to the disclosure, during the directivity optimisation sub-step, it is subtracted from each of the signals acquired by the microphones the signals acquired by the N−1 other microphones, each filtered by a FIR filter, in order to obtain N enhanced signals.

In one aspect of the disclosure, the N omnidirectional microphones are integrated into a device.

In one aspect of the disclosure, the FIR filter applied during the directivity optimisation sub-step to each acquired signal is equal to the ratio of the Z-transform of the impulse response of the microphone associated with the signal object of the subtraction over the Z-transform of the impulse response of the microphone associated with the signal to be filtered then subtracted, for an angle of incidence associated with a direction to be deleted.

In one aspect of the disclosure, said microphones are disposed in a circle on a plane, spaced apart by an angle equal to 360°/N.

In one aspect of the disclosure, the method implements four microphones spaced apart by an angle of 90° to the horizontal.

In one aspect of the disclosure, the device is a smartphone and the method implements two microphones, each placed on one lateral edge of said smartphone.

In one aspect of the disclosure, at least one Infinite Impulse Response IIR filter is applied to each of the enhanced signals during the directivity optimisation sub-step in order to correct the artefacts produced by the filtering operations using FIR filters.

In one aspect of the disclosure, the at least one IIR filter is a "peak" type filter, of which a central frequency fc, a quality factor Q and a gain $G_{dB}$ in decibels can be configured to compensate for the artefacts.

In one aspect of the disclosure, the order R of the ambisonics type format is equal to one.

In one aspect of the disclosure, the creation of the output signal in the ambisonics format is carried out by algebraic operations performed on the enhanced signals derived from the directivity optimisation sub-step in order to create the different channels of said ambisonics format.

The disclosure further relates to a sound signal processing system for implementing the method according to the disclosure. The system according to the disclosure includes means for:

- acquiring, in a synchronous manner, an input sound signal $S_{input}$ by means of N microphones, N being a natural number greater than or equal to two;
- encoding said input sound signal in a sound data D format of the ambisonics type of order R, R being a natural number greater than or equal to one;
- rendering an output sound signal by means of a digital processing of said sound data D.

According to the disclosure, the sound signal processing system includes means comprising Finite Impulse Response filters for filtering each of the signals acquired by the microphones and subtracting them from each of the other unfiltered original signals in order to obtain N enhanced signals.

BRIEF DESCRIPTION OF THE DRAWINGS

The disclosure will be better understood from the following description and the accompanying figures. These are intended for purposes of illustration only and are not intended to limit the scope of the disclosure.

DETAILED DESCRIPTION

Figure 1:
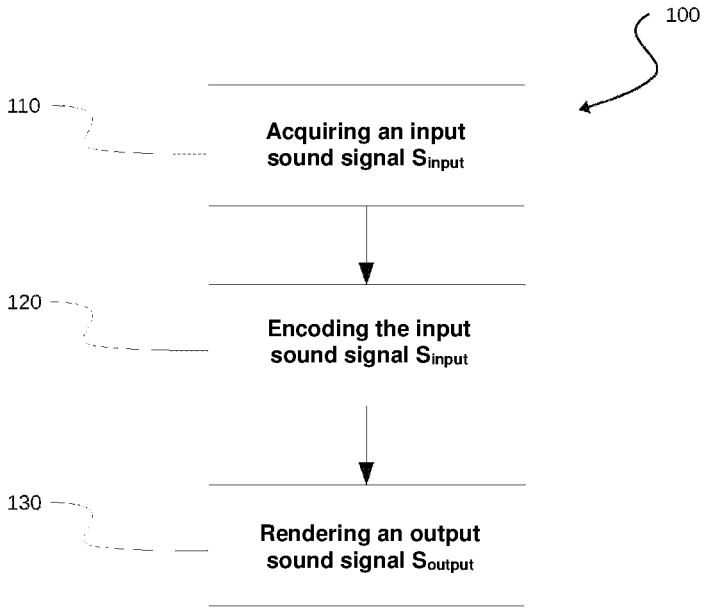
FIG. 1 shows the different steps of the method according to the disclosure.

With reference to FIG. 1, the present disclosure relates to a method 100 for processing a sound signal, comprising the following steps of:

- synchronously acquiring 110 an input sound signal $S_{input}$ by means of N microphones, N being a natural number greater than or equal to two;
- encoding 120 said input sound signal $S_{input}$ in a sound data D format of the ambisonics type of order R, R being a natural number greater than or equal to one;
- rendering 130 an output sound signal $S_{output}$ by means of digital processing of said sound data D.

In the aspect of the disclosure described hereafter, the acquisition 110 is carried out with a number N of microphones equal to two, and the order R is equal to 1 (the ambisonics format is thus referred to as "B-format"). The channels of the B-format will be denoted in the description below by (W; X; Y; Z) according to usual practice, these channels respectively representing:

- the omnidirectional sound component (W);
- the Front-Back sound component (X);
- the Left-Right sound component (Y);
- the Up-Down sound component (Z).

Figure 2:
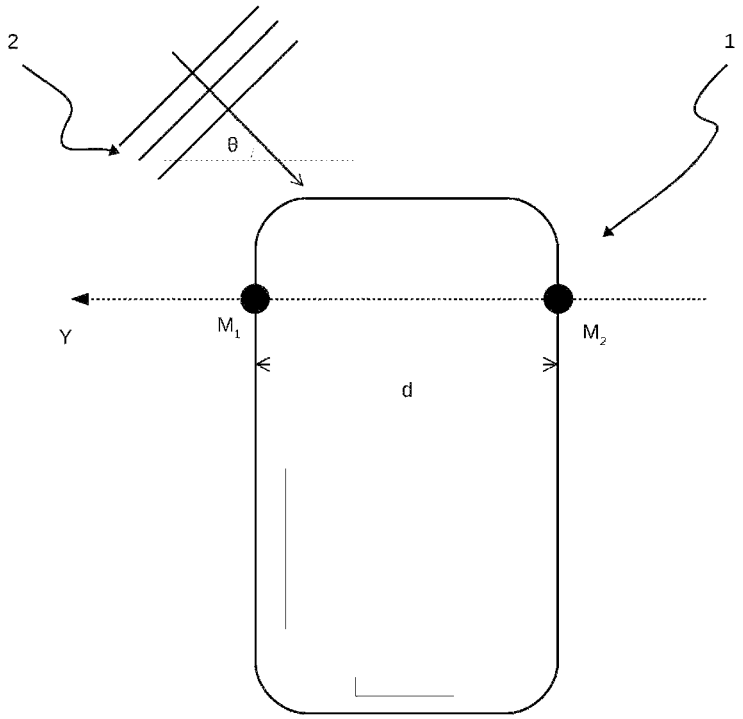
FIG. 2 shows a smartphone equipped with two microphones acquiring an acoustic wave.

Acquisition 110 consists of a recording of the sound signal $S_{input}$. With reference to FIG. 2, two omnidirectional microphones $M_1$, $M_2$, disposed at the periphery of a device 1, acquire an acoustic wave 2 of incidence θ relative to a straight line passing through the said microphones.

In the shown aspect of the disclosure, the device 1 is a smartphone.

The two microphones $M_1$; $M_2$ are considered herein to be disposed along the Y dimension. The reasonings that follow could be conducted in an equivalent manner while considering the two microphones to be disposed along the X dimension (Front-Back) or along the Z dimension (Up-Down), the disclosure not being limited by this choice.

At the end of the acquisition step 110, two sampled digital signals are obtained. $y_g$ is used to denote the signal associated with the "Left channel" and recorded by the microphone $M_1$ and $y_d$ is used to denote the signal associated with the "Right channel" and recorded by the microphone $M_2$, said signals $y_g$, $y_d$ constituting the input signal $S_{input}$.

$$S_{entrée} = \begin{pmatrix} y_g \\ y_d \end{pmatrix} S_{input}$$

As shown in FIG. 2, the microphone $M_1$ first acquires the acoustic wave 2 originating from the left. The microphone $M_2$ acquires it with a delay relative to the microphone $M_1$. The delay is in particular the result of:

- a distance d between the two microphones;
- the presence of an obstacle, in this case the device 1, causing in particular reflection and diffraction phenomena.

When the acoustic wave 2 has a plurality of frequencies, the delay with which the microphone $M_2$ acquires said acoustic wave depends on the frequency, in particular as a result of the presence of the device 1 between the microphones causing a diffraction phenomenon.

Similarly, each frequency of the acoustic wave is attenuated in a different manner, as a result of the presence of the device 1 on the one hand, and on the other hand as a function of the directivity properties of the microphones $M_1$, $M_2$ dependent on the frequency.

Moreover, since the microphones are both omnidirectional, they both reproduce the entire sound space.

Thereafter, the microphones $M_1$ and $M_2$ are sought to be differentiated by virtually modifying their directivity by processing the digital signals recorded, so as to be able to combine the modified signals to create the ambisonics format.

Figure 3:
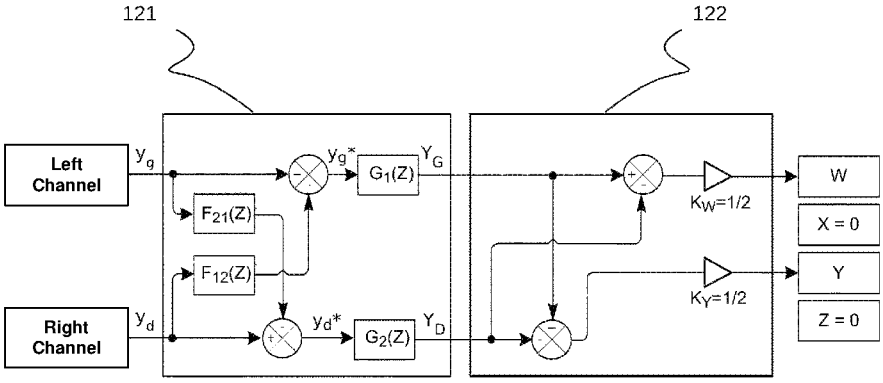
FIG. 3 shows a block diagram of the sub-steps of optimising the directivity of the microphones and of creating the ambisonics format.

FIG. 3 shows the processing operations applied to the digital signals obtained during the acquisition step 110, within the scope of the encoding step 120 of the method according to the disclosure.

In a directivity optimisation sub-step 121, a filter $F_{21}(Z)$ is applied to the signal $y_g$ of the "Left channel". The filtered signal is then subtracted from the signal $y_d$ of the "Right channel" by means of a subtractor.

According to the disclosure, the filter $F_{21}(Z)$ is of the Finite Impulse Response (FIR) filter type. Such a FIR filter allows each of the frequencies to be handled independently, by modifying the amplitude and the phase of the input signal over each of the frequencies, and thus allows the effects resulting from the presence of the device 1 between the microphones to be compensated.

By denoting as $H_1(Z, \theta)$ and $H_2(Z, \theta)$ the respective Z-transforms of the impulse responses of the microphones $M_1$ and $M_2$ when integrated into the device 1, in the direction of incidence given by the angle of incidence θ, the filter $F_{21}(Z)$ is determined by the relation:

$$F_{21}(Z) = \frac{H_2(Z, \theta = 0^\circ)}{H_1(Z, \theta = 0^\circ)}$$

The choice of a zero angle of incidence θ when determining the filter $F_{21}(Z)$ allows the sound component originating from the left to be isolated. Thus, after subtracting the signals, an enhanced signal $y_d$* associated with the "Right channel", from which the sound component originating from the left has been substantially deleted, is obtained.

The directivity of the microphone $M_2$ is thus virtually modified so as to essentially acquire the sounds originating from the right.

The same operation is carried out in a similar manner for the Left channel. Similarly, a filter $F_{12}(Z)$ is applied to the signal $y_d$ of the Right channel. The filtered signal is then subtracted from the signal $y_g$ of the "Left channel" by means of a subtractor. The filter $F_{12}(Z)$ is a FIR filter defined by the relation:

$$F_{12}(Z) = \frac{H_1(Z, \theta = 180^\circ)}{H_2(Z, \theta = 180^\circ)}$$

The choice of an angle of incidence θ equal to 180° when determining the filter $F_{12}(Z)$ allows the sound component originating from the right to be isolated. Thus, after subtracting the signals, an enhanced signal $y_g$* associated with the "Left channel", from which the sound component originating from the right has been substantially deleted, is obtained.

The directivity of the microphone $M_1$ is thus virtually modified so as to essentially acquire the sounds originating from the left.

In practice, the filters $F_{21}(Z)$ and $F_{12}(Z)$ have properties of high-pass filters and their application produces artefacts. In particular, the frequency spectrum of the enhanced signals $y_g$*, $y_d$* is attenuated in the low frequencies and altered in the high frequencies.

In order to correct these defects, at least one filter $G_1(Z)$, $G_2(Z)$ of the Infinite Impulse Response (IIR) filter type is applied to the enhanced signals $y_g$* and $y_d$* respectively.

Figure 4:
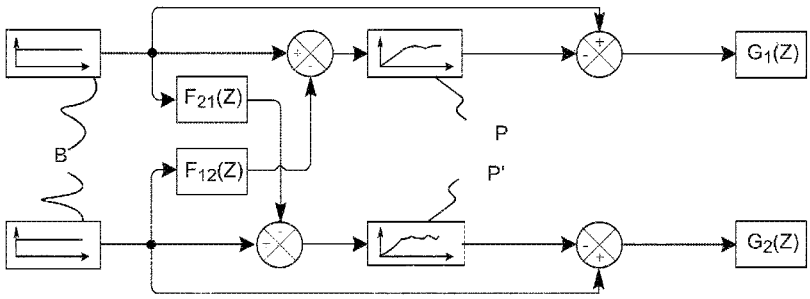
FIG. 4 shows a block diagram for determining Infinite Impulse Response filters used during the directivity optimisation sub-step.

In order to determine the at least one filter $G_1(Z)$ $G_2(Z)$ to be applied, a white noise B is filtered by the filters $F_{21}(Z)$, $F_{12}(Z)$ previously determined, as shown in FIG. 4. The filtered signals are then subtracted from the original white noise B. The comparison of the profiles P, P' of the output signals with the white noise B allows to determine the one or more filters $G_1(Z)$, $G_2(Z)$ to be applied to correct the alterations of the frequency spectrum as a result of the processing of the signals, during the sub-step 121.

In one aspect of the disclosure, the IIR filters are "peak" type filters, of which a central frequency fc, a quality factor Q and a gain $G_{dB}$ in decibels can be configured to correct the artefacts. Thus, an attenuated frequency could be corrected by a positive gain, an accentuated frequency could be corrected by a negative gain.

Thus, after filtering by the at least one IIR filter $G_1(Z)$, $G_2(Z)$, a corrected signal $Y_G$ is obtained, representative of the sounds originating from the left and a corrected signal $Y_D$ is obtained, representative of the sounds originating from the right.

Thereafter, with reference to FIG. 3, the output in ambisonics format is created 122.

In order to obtain the omnidirectional component W of the sound signal, the corrected signals $Y_D$, $Y_G$ are added and the result is normalised by multiplying by a gain $K_W$ equal to 0.5:

$$W = \frac{Y_G + Y_D}{2}$$

On the basis of the convention according to which the Y component is positive if the sound essentially originates from the left, the Left-Right sound component is obtained by subtracting the corrected signal $Y_D$ associated with the "Right channel" from the corrected signal $Y_G$ associated with the "Left channel". The result is normalised by multiplying by a factor $K_Y$ equal to 0.5:

$$Y = \frac{Y_G - Y_D}{2}$$

Given that no information is known on the Front-Back and Up-Down components, the X and Z components are set to zero.

At the end of the encoding step 120, data D in B-format is obtained (in the present aspect of the disclosure, the signals W and Y, the other signals X and Z being set to zero):

$$D = \begin{pmatrix} \frac{Y_G + Y_D}{2} \\ 0 \\ \frac{Y_G - Y_D}{2} \\ 0 \end{pmatrix}$$

The corrected signals $Y_G$, $Y_D$ of the Left and Right channels respectively can be reproduced by adding and subtracting the signals W and Y:

$$\begin{pmatrix} Y_G \\ Y_D \end{pmatrix} = \begin{pmatrix} W + Y \\ W - Y \end{pmatrix}$$

The rendering step 130 consists of rendering the sound signal, thanks to a transformation of the data in ambisonics format into binaural channels.

In one method of implementing the disclosure, the data D in ambisonics format is transformed into data in binaural format.

The disclosure is not limited to the aspect of the disclosure described hereinabove. In particular, the number of microphones used can be greater than two.

Figure 5:
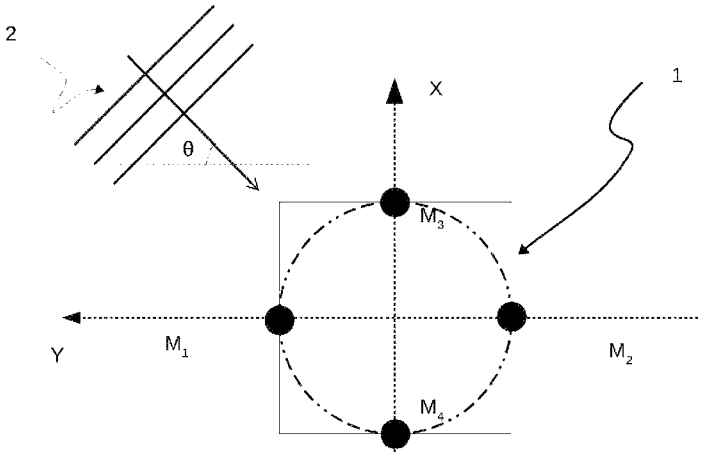
FIG. 5 shows a device including two pairs of microphones, the two directions defined by the two pairs of microphones being orthogonal.

In one alternative aspect of the disclosure of the method 100 according to the disclosure, four omnidirectional microphones $M_1$, $M_2$, $M_3$, $M_4$ disposed at the periphery of a device 1, acquire an acoustic wave 2 of incidence θ relative to a straight line passing through the microphones $M_1$ and $M_2$, as shown in FIG. 5.

The two microphones $M_1$; $M_2$ are considered herein to be disposed along the Y dimension and the two microphones $M_3$, $M_4$ are considered herein to be disposed along the X dimension. The four microphones are disposed in a circle, shown by dash-dot lines in FIG. 5.

At the end of the acquisition step 110, four sampled digital signals are obtained. The following denotations are applied:

- $y_g$ denotes the signal associated with the "Left channel" and recorded by the microphone $M_1$;
- $y_d$ denotes the signal associated with the "Right channel" and recorded by the microphone $M_2$;
- $x_{av}$ denotes the signal associated with the "Front channel" and recorded by the microphone $M_3$;
- $x_{ar}$ denotes the signal associated with the "Back channel" and recorded by the microphone $M_4$;

the said signals $y_g$, $y_d$, $x_{av}$, $x_{ar}$ constituting the input signal $S_{input}$:

$$S_{entrée} = \begin{pmatrix} y_g \\ y_d \\ x_{av} \\ x_{ar} \end{pmatrix} S_{input}$$

Figure 6:
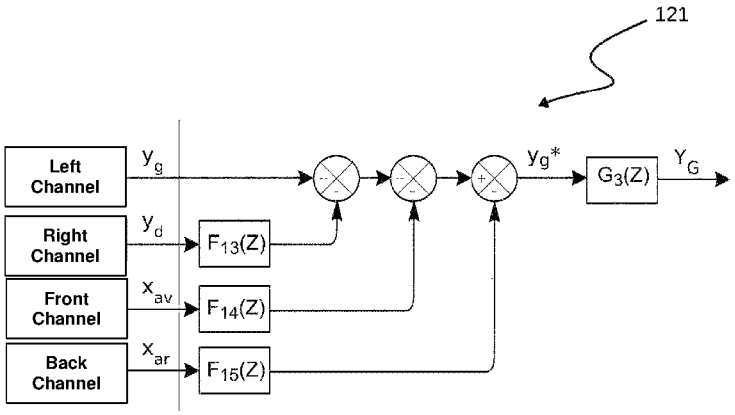
FIG. 6 shows a block diagram for the optimisation of the Left channel in the aspect of the disclosure shown in FIG. 5 comprising four microphones.

With reference to FIG. 6, the directivity optimisation sub-step 121 is shown for this aspect of the disclosure. For clarity purposes, only the processing of the signal $y_g$ associated with the Left channel is shown.

In this aspect of the disclosure, the enhanced signal $y_g$* is obtained by subtracting the signals $y_d$, $x_{av}$ and $x_{ar}$ respectively filtered by FIR filters $F_{12}(Z)$, $F_{13}(Z)$ and $F_{14}(Z)$ from the signal $y_g$ acquired by the microphone $M_1$, which filters are defined by:

$$F_{12}(Z) = \frac{H_1(Z, \theta = 180^\circ)}{H_2(Z, \theta = 180^\circ)}$$

$$F_{13}(Z) = \frac{H_1(Z, \theta = 90^\circ)}{H_3(Z, \theta = 90^\circ)}$$

$$F_{14}(Z) = \frac{H_1(Z, \theta = 270^\circ)}{H_4(Z, \theta = 270^\circ)}$$

where $H_1(Z, \theta)$, $H_2(Z, \theta)$, $H_3(Z, \theta)$, $H_4(Z, \theta)$ denote the respective Z-transforms of the impulse responses of the microphones $M_1$, $M_2$, $M_3$, $M_4$ when integrated into the device 1, for an angle of incidence θ.

The choice of the angles of incidence 180°, 90°, 270° when determining the filters allows the sound components respectively originating from the right, from the front and from the back to be isolated.

Thus, after subtracting the signals, an enhanced signal $y_g$* associated with the "Left channel" is obtained, from which the sound components originating from the right, from the front and from the back have been substantially deleted.

A filter $G_3(Z)$ of the IIR type is then applied to correct the artefacts generated by the filtering operations using FIR filters.

At the end of this step, the corrected signal $Y_G$ is obtained.

Similar processing operations can be applied to the signals of the Right, Front and Back channels, in order to respectively obtain the corrected signals $Y_D$, $X_{AV}$, $X_{AR}$.

Figure 7:
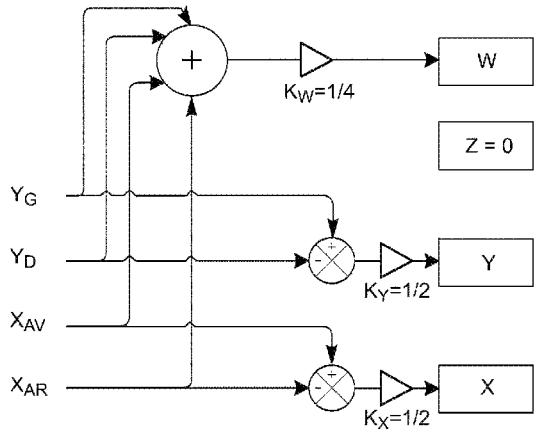
FIG. 7 shows a block diagram for the creation of the ambisonics format in the aspect of the disclosure shown in FIG. 5.
Figure 8:
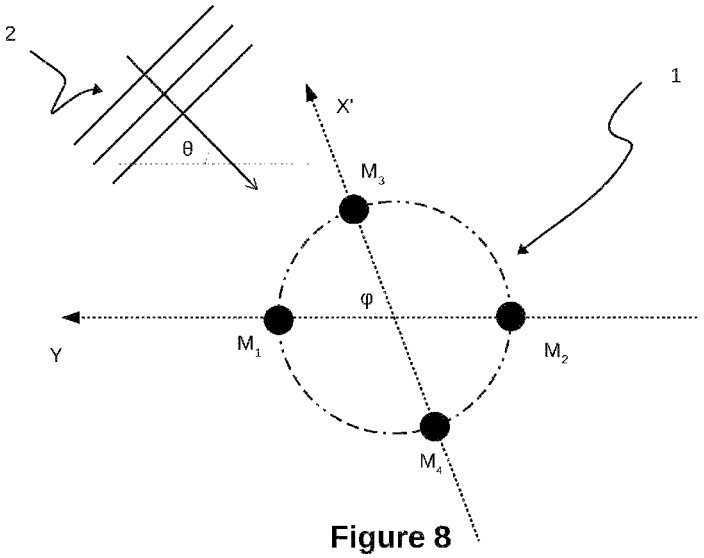
FIG. 8 shows two pairs of microphones acquiring an acoustic wave, the two directions defined by the two pairs of microphones forming an angle of strictly less than 90°.

FIG. 7 describes the sub-step 122 of creating the ambisonics format in the aspect of the disclosure using four microphones described hereinabove.

In order to obtain the omnidirectional component W of the sound signal, the corrected signals $Y_D$, $Y_G$, $X_{AV}$, $X_{AR}$ are added and the result is normalised by multiplying by a gain $K_W$ equal to one quarter:

$$W = \frac{Y_G + Y_D + X_{AV} + X_{AR}}{4}$$

On the basis of the convention according to which the Y component is positive if the sound essentially originates from the left, the Left-Right sound component is obtained by subtracting the corrected signal $Y_D$ associated with the "Right channel" from the corrected signal $Y_G$ associated with the "Left channel". The result is normalised by multiplying by the factor $K_Y$ equal to one half:

$$Y = \frac{Y_G - Y_D}{2}$$

On the basis of the convention according to which the X component is positive if the sound essentially originates from the front, the Front-Back sound component is obtained by subtracting the corrected signal $X_{AR}$ associated with the Back channel from the corrected signal $X_{Av}$ associated with the Front channel. The result is normalised by multiplying by the factor $K_X$ equal to one half:

$$X = \frac{X_{AV} - X_{AR}}{2}$$

In one alternative aspect, the disclosure includes six microphones in order to integrate the Z component of the ambisonics format.

In alternative aspects of the disclosure, the order R of the ambisonics format is greater than or equal to 2, and the number of microphones is adapted so as to integrate all of the components of the ambisonics format. For example, for an order R equal to two, eighteen microphones are implemented in order to form the nine components of the corresponding ambisonic format.

The FIR filters applied to the signals acquired are adapted accordingly, in particular the angle of incidence θ considered for each filter is adapted so as to remove, from each of the signals, the sound components originating from unwanted directions in space.

For example, with reference to FIG. 7, an angle φ between a direction Y through which the microphones $M_1$ and $M_2$ pass and a direction X' through which the microphones $M_3$ and $M_4$ pass is strictly less than 90°.

In this aspect of the disclosure, the filter applied to the signal recorded by $M_3$ and subtracted from the signal acquired by $M_1$ is given by:

$$F_{13}(Z) = \frac{H_1(Z, \theta = \varphi)}{H_3(Z, \theta = \varphi)}$$

In this manner, after subtracting the filtered signal from the signal acquired by $M_1$, an enhanced signal is obtained from which the sound component in the X' direction has been deleted.

Thus, an ambisonics format of an order greater than or equal to two can be created by adding, for example, microphones in the directions such that φ=45°, φ=90° or φ=135°.

The present disclosure further relates to a sound signal processing system, comprising means for:

acquiring, in a synchronous manner, an input sound signal $S_{input}$ by means of N microphones, N being a natural number greater than or equal to two;

encoding the said input sound signal $S_{input}$ in a sound data D format of the ambisonics type of order R, R being a natural number greater than or equal to one, said means being implemented using filters of the FIR type and using IIR filters of the "peak" type;

rendering an output sound signal $S_{output}$ by means of a digital processing of said sound data D.

This sound signal processing system comprises at least one computation unit and one memory unit.

The above description of the disclosure is provided for the purposes of illustration only. It does not limit the scope of the disclosure.

What is claimed is:

1. A method for processing a sound signal, the method comprising:

synchronously acquiring an input sound signal by each of N omnidirectional microphones, N being a natural number greater than or equal to two;

encoding said input sound signal in a sound data format of the ambisonics type of order R, R being a natural number greater than or equal to one, said encoding step comprising a directivity optimisation sub-step carried out by means of filters of the Finite Impulse Response (FIR) filter type, and said encoding step comprising a sub-step of creating an output sound signal in the ambisonics format from N enhanced signals derived from the directivity optimisation sub-step;

rendering the output sound signal by means of a digital processing of said sound data; and during the directivity optimisation sub-step, it is subtracted from each of the N input sound signals acquired by the microphones the input sound signals acquired by the N−1 other microphones, each input sound signal acquired by the N−1 other microphones being filtered by a respective one of the FIR filters, in order to obtain the N enhanced signals, wherein the FIR filter applied during the directivity optimisation sub-step to each acquired signal is equal to the ratio of the Z-transform of the impulse response of the microphone associated with the signal object of the subtraction over the Z-transform of the impulse response of the microphone associated with the signal to be filtered then subtracted, for an angle of incidence associated with a direction to be deleted.

2. The method according to claim 1, wherein the N omnidirectional microphones are integrated into a device.

3. The method according to claim 2, wherein the device is a smartphone and wherein the method implements two microphones, each placed on one lateral edge of said smartphone.

4. The method according to claim 1, wherein the microphones are disposed in a circle on a plane, spaced apart by an angle equal to 360°/N.

5. The method according to claim 4, wherein the method implements four microphones spaced apart by an angle of 90° to the horizontal.

6. The method according to claim 1, wherein at least one Infinite Impulse Response (IIR) filter is applied to each of the enhanced signals during the directivity optimisation sub-step in order to correct the artefacts produced by the filtering operations using FIR filters.

7. The method according to claim 6, wherein the at least one IIR filter is a "peak" type filter, of which a central frequency, a quality factor and a gain in decibels can be configured to compensate for the artefacts.

8. The method according to claim 1, wherein the order R of the ambisonics type format is equal to one.

9. The method according to claim 1, wherein the creation of the output signal in the ambisonics format is carried out by algebraic operations performed on the enhanced signals derived from the directivity optimisation sub-step in order to create the different channels of said ambisonics format.

10. A system for processing a sound signal, the system comprising:

acquiring, in a synchronous manner, an input sound signal by each of N microphones, N being a natural number greater than or equal to two;

encoding said input sound signal in a sound data format of the ambisonics type of order R, R being a natural number greater than or equal to one; and rendering an output sound signal by means of a digital processing of said sound data;

wherein said system for processing the sound signal includes means comprising Finite Impulse Response (FIR) filters for filtering each of the N input sound signals acquired by the microphones and subtracting from each of the N input sound signals acquired by the microphones the input sound signals acquired by the N−1 other microphones, each input sound signals acquired by the N−1 other microphones being filtered by a respective one of the FIR filters, in order to obtain N enhanced signals, wherein the FIR filter applied during the directivity optimisation sub-step to each acquired signal is equal to the ratio of the Z-transform of the impulse response of the microphone associated with the signal object of the subtraction over the Z-transform of the impulse response of the microphone associate with the signal to be filtered then subtracted, for an angle of incidence associated with a direction to be deleted.

* * * * *